US005949385A

United States Patent [19]

Asakura et al.

[11] Patent Number: 5,949,385

[45] **Date of Patent: *Sep. 7, 1999**

[54] ANTENNA INTEGRAL WITH PRINTED CIRCUIT BOARD

[75] Inventors: Kenji Asakura, Shiga-ken; Teruhisa Tsuru, Kameoka; Seiji Kanba, Otsu; Tsuyoshi Suesada, Omihachiman, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/798,834

[22] Filed: Feb. 12, 1997

[30] Foreign Application Priority Data

Feb. 16, 1996 [JP] Japan ..... 8-029361

[51] Int. Cl.[6] ..... H01Q 1/24; H01Q 11/08

[52] U.S. Cl. ..... 343/895; 343/702; 343/873

[58] Field of Search ..... 343/702, 895, 343/718, 860, 866, 872, 873; H01Q 1/24, 1/12, 11/08

[56] References Cited

U.S. PATENT DOCUMENTS 5,450,090 9/1995 Gels et al. ..... 343/700 MS
5,541,610 7/1996 Imanishi et al. ..... 343/702

FOREIGN PATENT DOCUMENTS 743699 11/1996 European Pat. Off. .
759646 2/1997 European Pat. Off. .
762539 3/1997 European Pat. Off. .

*Primary Examiner*—Hoanganh Le
*Attorney, Agent, or Firm*—Ostrolenk, Faber, Gerb & Soffen, LLP

[57] ABSTRACT

A compact non-directional chip antenna. The chip antenna includes a rectangular-parallelopiped base made of printed circuit boards (specific inductive capacity: about 2 to 6) having a glass epoxy resin or glass fluororesin as main constituents, a conductor, made of copper or a copper alloy, which is wound in the shape of a spiral inside the base along the direction of the length of the base, and a power feeding terminal, for applying a voltage to the conductor, on the surface of the base. One end of the conductor forms a power feeding section and is connected to the power feeding terminal. The other end of the conductor forms a free end inside the base.

16 Claims, 4 Drawing Sheets

ANTENNA INTEGRAL WITH PRINTED CIRCUIT BOARD

BACKGROUND OF THE INVENTION

1. Field of the Invention

The present invention relates to a chip antenna and, more particularly, to a chip antenna for use in mobile communication equipment used for mobile communications and local area networks (LAN).

2. Description of the Related Art

A conventional circularly-polarized-wave antenna 50 formed on a printed circuit board is generally structured as shown in FIGS. 8A and 8B. More specifically, a radiation conductor 52 made of a square-shaped radiation conductor film, a 90° hybrid coupler 53 and two strip lines 54 and 55 are coated onto a printed circuit board 51. A non-reflective terminator 56 is mounted to one of the terminals of the 90° hybrid coupler 53, and a matching circuit 57 is inserted between the output side of the 90° hybrid coupler 53 and the strip lines 54 and 55. Further, a grounding radiation conductor film 59 is coated on the rear surface of the printed circuit board 51.

In the circularly-polarized-wave antenna 50, when a signal is input from a power feeding terminal 58, two outputs which have an equal amplitude and which are 90° out of phase are fed from the 90° hybrid coupler 53 through the matching circuit 57 to the strip lines 54 and 55. Since each of the strip lines 54 and 55 is connected to the central portion of the adjacent sides of the radiation conductor 52, electric currents excited by the strip line 54 and the strip line 55 flow intersecting at right angles on the radiation conductor 52, causing a circularly-polarized wave to be excited on the radiation conductor 52.

However, in the above-described conventional circularly-polarized-wave antenna, because, in addition to radiation conductors and strip lines, a 90° hybrid coupler, a non-reflective terminator, a matching circuit and the like are required, the area required by one antenna becomes large. For this reason, there arises the problem that the mobile communication equipment in which the antenna is mounted becomes large. There is also another problem in that because a grounding radiation conductor film is coated on the rear surface of a base formed of printed circuit boards, a non-directional characteristic cannot be obtained.

SUMMARY OF THE INVENTION

The present invention has been achieved to solve the above-described problems. It is an object of the present invention to provide a small, non-directional chip antenna.

To achieve the above and other objects, according to the present invention, there is provided a chip antenna, comprising a base comprising at least one printed circuit board, at least one radiation conductor formed at least one of on the surface of and inside of the base; and at least one power feeding terminal, formed on the surface of the base, for applying a voltage to the radiation conductor.

The radiation conductor is wound in the shape of a spiral. Further, the radiation conductor may be formed in a meandering shape having at least one corner.

According to the chip antenna of the present invention, since a grounding radiation conductor film 59 is not provided on a base made of a printed circuit board, radio waves are not shielded, and thus a non-directional antenna can be obtained.

The above and further objects, aspects and novel features of the invention will become more apparent from the following detailed description when read in connection with the accompanying drawings.

DETAILED DESCRIPTION OF EMBODIMENTS OF THE INVENTION

Figure 1:
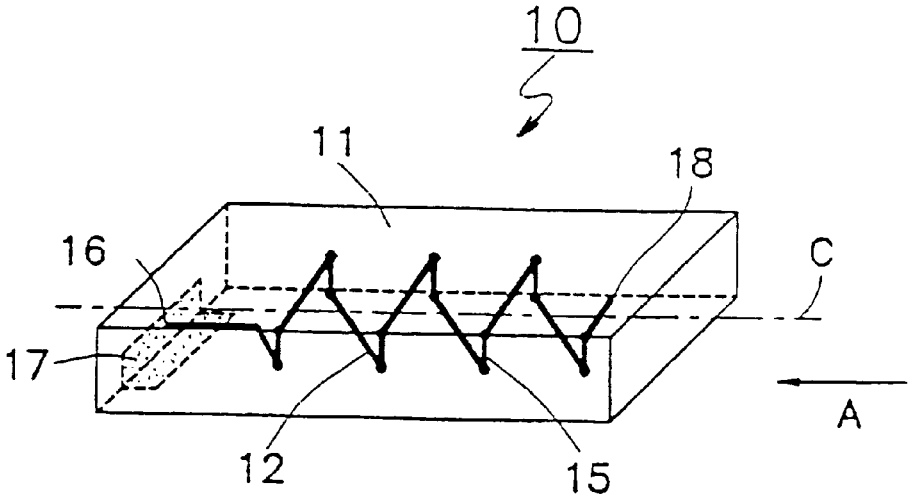
FIG. 1 is a perspective view of a first embodiment of a chip antenna according to the present invention.

The preferred embodiments of the present invention will be described below with reference to the accompanying drawings. In the embodiments, the same or like components as those of the first or previously described embodiments are given the same reference numerals, and thus a detailed description thereof is omitted.

Figure 2:
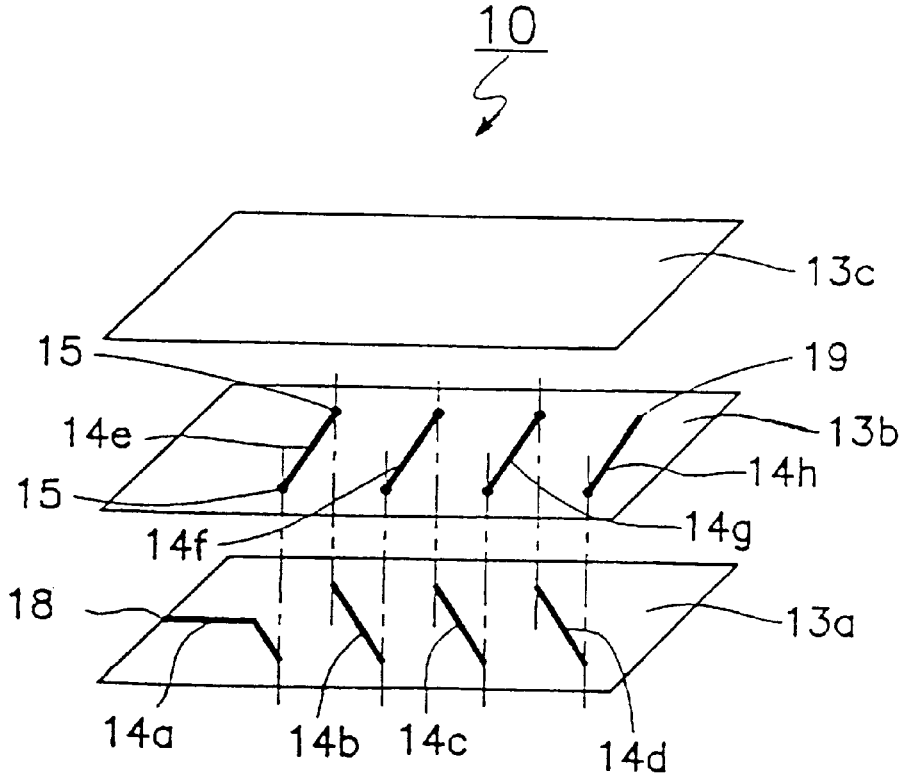
FIG. 2 is an exploded, perspective view of the chip antenna shown in FIG. 1.

FIGS. 1 and 2 show, respectively, a perspective view and an exploded, perspective view of a first embodiment of a chip antenna of the present invention.

The chip antenna 10 comprises a radiation conductor 12 which is wound in the shape of a spiral inside a rectangular-parallelopiped base 11 along the direction of the length of the base 11. The base 11 comprises rectangular laminated sheet layers 13*a* to 13*c* made of printed circuit boards (specific inductive capacity: about 2 to 6) having a glass epoxy resin or glass fluororesin as their main constituents.

Rectangular or substantially L-shaped conductive patterns 14*a* to 14*h* are formed on the surfaces of the sheet layers 13*a* and 13*b* from among the above sheet layers by printing, evaporation, pasting or plating. Further, viaholes 15 are provided at predetermined positions (one end or both ends of each of the conductive patterns 14*e* to 14*h*) on the sheet layer 13*b* along the direction of the thickness of the base.

By laminating the sheet layers 13*a* to 13*c* and connecting the conductive patterns 14*a* to 14*h* by the viaholes 15, the radiation conductor 12 is formed inside the base 11, which radiation conductor has a rectangular-shaped winding cross section which is wound in the shape of a spiral along the direction of the length of the base 11.

One end (one end of the conductive pattern 14*a*) of the radiation conductor 12 is extended onto the surface of the base 11, forming a power feeding section 16, and is connected to a power feeding terminal 17 formed on the surface of the base 11 in order to apply a voltage to the radiation conductor 12. The other end (one end of the conductive pattern 14*h*) of the radiation conductor 12 forms a free end 18 inside the base 11.

Figure 3:
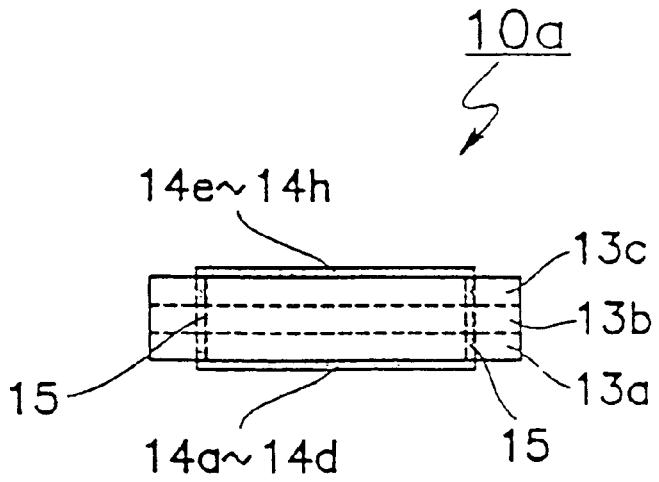
FIG. 3 is a side view illustrating a first modification of the chip antenna shown in FIG. 1.
Figure 4:
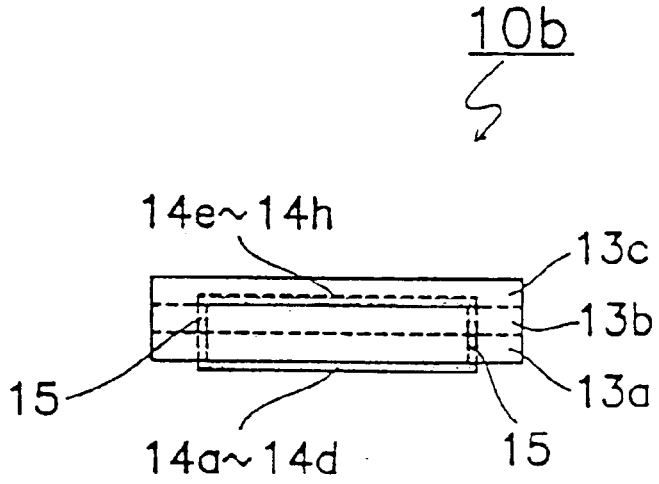
FIG. 4 is a side view illustrating a second modification of the chip antenna shown in FIG. 1.

FIGS. 3 and 4 show side views of a first and a second modification of the chip antenna 10. These side views show cases when seen from the direction A in the perspective view of FIG. 1.

In a chip antenna 10*a*, which is a first modification of the first embodiment, the conductive patterns 14*a* to 14*d* are provided on the rear surface of the sheet layer 13*a,* the conductive patterns 14*e* to 14*h* are provided on the obverse surface of the sheet layer 13*c,* and the conductive patterns 14*a* to 14*h* are connected by the viaholes 15, thus forming a part of the radiation conductor 12 on the surface of the base 11.

In a chip antenna 10*b,* which is a second modification of the first embodiment, the conductive patterns 14*a* to 14*d* are provided on the rear surface of the sheet layer 13*a,* the conductive patterns 14*e* to 14*h* are provided on the obverse surface of the sheet layer 13*b,* and the conductive patterns 14*a* to 14*h* are connected by the viaholes 15, thus forming a part of the radiation conductor 12 on the surface of the base 11. Even when the conductive patterns 14*a* to 14*h* are provided on the obverse surface of the sheet layer 13*a* and the obverse surface of the sheet layer 13*c* in FIG. 2, a similar chip antenna can be formed.

Figure 5:
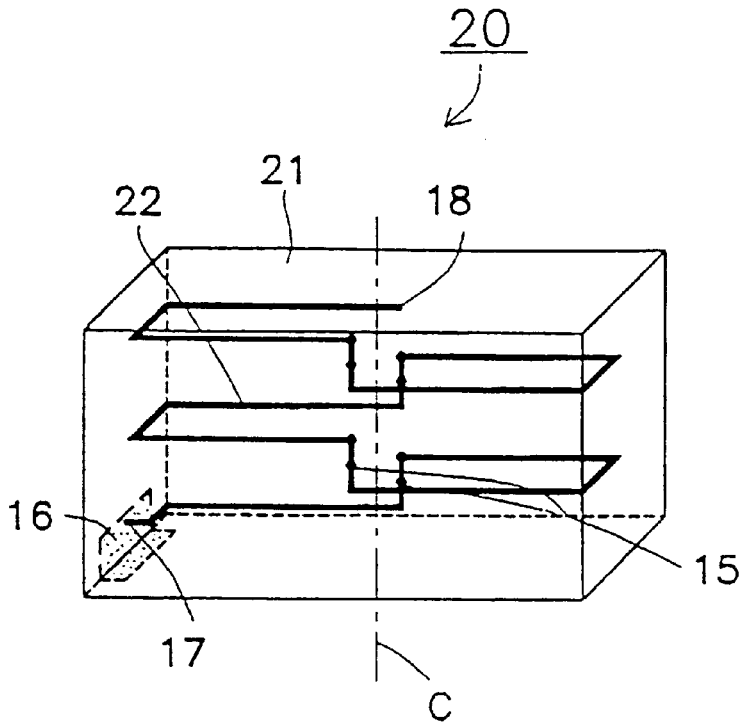
FIG. 5 is a perspective view of a second embodiment of a chip antenna according to the present invention.

FIG. 5 shows a perspective view of a second embodiment of a chip antenna of the present invention.

The chip antenna 20 differs from the chip antenna 10 in that a radiation conductor 22 is wound in the shape of a spiral along the direction of the height of a base 21. Also in the chip antenna 20, a part of the radiation conductor 22 may be provided on the surface of the base 21 in the same manner as in the chip antenna 10.

Figure 6:
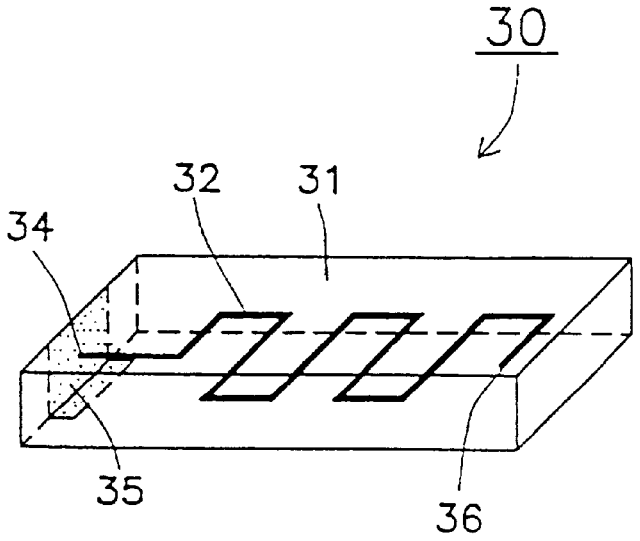
FIG. 6 is a perspective view of a third embodiment of a chip antenna according to the present invention.
Figure 7:
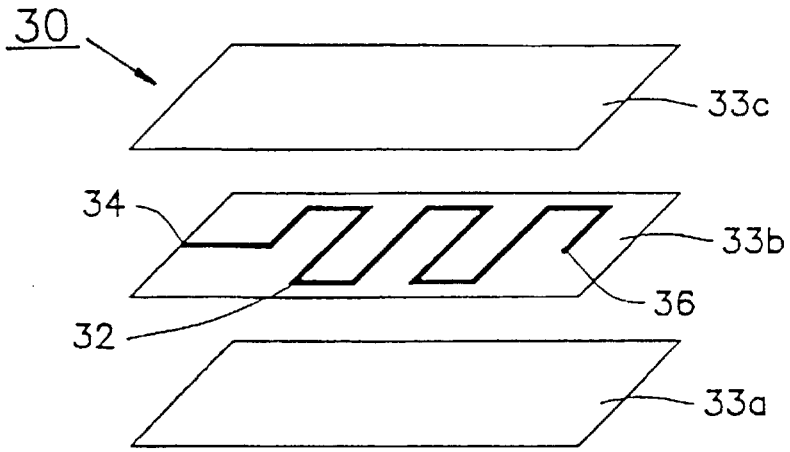
FIG. 7 is an exploded, perspective view of the chip antenna shown in FIG. 6.
Figure 8A:
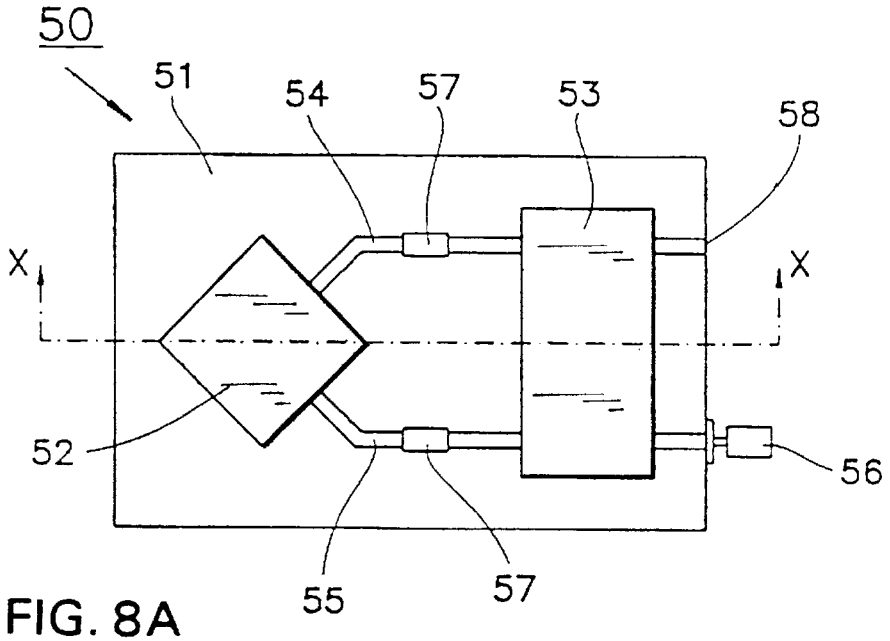
FIG. 8A PRIOR ART
FIG. 8A is a plan view illustrating a conventional circularly-polarized-wave antenna.
Figure 8B:
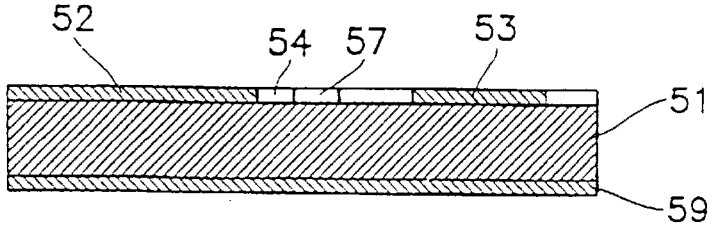
FIG. 8B PRIOR ART
FIG. 8B is a sectional view of the conventional antenna taken in the direction of the arrows along the line X—X in FIG. 8A.

FIGS. 6 and 7 respectively show a perspective view and an exploded, perspective view of a third embodiment of a chip antenna of the present invention.

A chip antenna 30 comprises a radiation conductor 32 formed in a meandering shape having 10 corners inside a rectangular-parallelopiped base 31. The base 31 comprises rectangular laminated sheet layers 33*a* to 33*c* made of printed circuit boards (specific inductive capacity: about 2 to 6) having a glass epoxy resin or glass fluororesin as their main constituents.

A radiation conductor 32 made of copper or a copper alloy in a meandering shape is provided on the surface of the sheet layer 13*b* from among the above sheet layers by printing, evaporation, pasting or plating. Thereafter, the sheet layers 33*a* to 33*c* are laminated, and the radiation conductor 32 in a meandering shape is formed inside the base 31.

The meandering-shaped base 31 is provided from one of the facing sides of the rectangular-parallelopiped base 31 to the other side. One end of the radiation conductor 32 is extended onto the surface of the base 31, forming a power feeding section 34, and is connected to a power feeding terminal 35 formed on the surface of the base 31 in order to apply a voltage to the base 31. The other end of the radiation conductor 32 forms a free end 36 inside the base 31.

Although the first to third embodiments describe a case in which the base of the chip antenna is shaped like a rectangular parallelopiped, other shapes may be possible, for example, a cube, circular cylinder, pyramid, cone or sphere.

Although a case utilizing one radiation conductor is described, two or more radiation conductors may be formed. In such a case, it is possible to have a plurality of resonance frequencies. Further, the position of the power feeding terminal shown in the drawings is not an indispensable condition for embodying the present invention.

Although the first and second embodiments describe a case in which the entire radiation conductor or a part of the conductor is provided inside the base, the entire radiation conductor may be provided on the surface of the base. Further, although a case is described in which the shape of the winding cross section intersecting at right angles to the winding axis C of a conductor wound in the shape of a spiral is substantially rectangular, the shape of the winding cross section may have a straight-line portion in at least a part thereof. In such a case, since the radiation conductor is responsive principally to polarized waves and intersecting polarized waves from the direction of the winding axis and a direction perpendicular to the winding axis, a non-directional chip antenna can be realized.

Although the third embodiment describes a case in which the meandering-shaped radiation conductor is formed from one of the facing sides to the other side, the radiation conductor may be formed in any direction as long as it is formed in a meandering shape.

Further, although a case is described in which a radiation conductor with a meandering shape is provided on one sheet layer, a radiation conductor in a meandering shape may be formed by providing a radiation conductor pattern on a plurality of sheet layers and by connecting these radiation conductor patterns. Also, although a case is described in which the entire radiation conductor is provided inside the base, a part of the radiation conductor or the entire radiation conductor may be provided on the surface of the base.

In addition, although a case is described in which the number of corners of the radiation conductor in a meandering shape is 10, a radiation conductor with one or more corners may be formed according to the line length. Furthermore, although a case is described in which the meandering shape is substantially rectangular, the meandering shape may be substantially wave shaped or saw-tooth shaped.

According to the chip antenna of the present invention, since the chip antenna is formed of a base made of printed circuit boards and a radiation conductor, a small size can easily be achieved. Further, since a grounding radiation conductor film is not provided on a base made of printed circuit boards, radio waves are not shielded by the grounding radiation conductor film, and thus a non-directional antenna can be obtained. In addition, since the radiation conductor is wound in a spiral form or formed in a meandering shape, it becomes possible to increase the line length of the conductor. Therefore, it is possible to widen the bandwidth without decreasing the gain.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An antenna comprising:

a base comprising at least one printed circuit board having a surface;

at least one radiation conductor disposed spirally on the surface of the base;

at least one power feeding terminal provided on a portion of the surface of said base for applying voltage to the radiation conductor, the radiation conductor having one end coupled to the power feeding terminal and a second end left unconnected; and said base comprising a plurality of layers laminated on top of each other thereby forming stacked layers, each layer having a layer surface, the stacked layers establishing a direction of the stacked layers normal to the layer surface of each of the stacked layers, the radiation conductor disposed spirally on the surface of the base having a spiral axis extending perpendicular to the direction of the stacked layers.

2. The antenna of claim 1, wherein selected portions of the radiation conductor are disposed on respective surfaces of selected ones of the printed circuit boards, conductive through holes being provided on at least one of the printed circuit boards to connect the portions of the conductor together to form the radiation conductor when the circuit boards are laminated together.

3. The antenna of claim 2 wherein the portions of the radiation conductor are disposed on respective top and bottom surfaces of the printed circuit boards.

4. The antenna of claim 3, wherein the portions of the conductor are disposed in part on a surface of at least one printed circuit board so that at least a portion of the conductor is provided on a surface of the base when the circuit boards are laminated together.

5. The antenna of claim 3, wherein the radiation conductor is disposed partly on the surface of the base and partly on surfaces of at least one printed circuit board disposed within the base.

6. The antenna of claim 2, wherein the conductor has a rectangular shape in transverse cross section.

7. The antenna of claim 2, wherein the conductor has a meander shape, sections of which are disposed on at least two printed circuit boards connected by through holes.

8. The antenna of claim 1, wherein the conductor has at least one linear portion in transverse cross section.

9. The antenna of claim 1, wherein the conductor is disposed entirely within the base.

10. The antenna of claim 1, wherein the conductor is disposed entirely on the surface of the base.

11. The antenna of claim 1, wherein the conductor is disposed partly in the base and partly on the surface of the base.

12. The antenna of claim 1, wherein the base is a rectangular parallelopiped.

13. The antenna of claim 1, wherein the printed circuit board comprises glass epoxy resin or glass fluororesin.

14. The antenna of claim 1, wherein the conductor comprises copper or a copper alloy.

15. The antenna of claim 1, wherein the conductor is made by one of printing, evaporation, pasting and plating.

16. An antenna comprising:

a base comprising a printed circuit board, the printed circuit board comprising a plurality of layers laminated on top of each other thereby forming stacked layers, each layer having a layer surface, the stacked layers establishing a direction of the stacked layers normal to the layer surface of each of the stacked layers;

at least one radiation conductor disposed in or on the base, the radiation conductor comprising a plurality of conductor portions disposed on at least two of the layers and interconnected together when the layers are laminated together to form the radiation conductor, the radiation conductor having a spiral shape extending in three dimensions;

at least one power feeding terminal provided on a portion of a surface of said base for applying voltage to the radiation conductor, the radiation conductor having one end coupled to the power feeding terminal and a second end left unconnected; and the radiation conductor having a spiral axis extending perpendicular to the direction of the stacked layers.

* * * * *